United States Patent [19]

Brown

[11] Patent Number: 4,467,946

[45] Date of Patent: Aug. 28, 1984

[54] MICROMETER HOLDER

[76] Inventor: Joann Brown, 602 Jamestown St., Wattsburg, Pa. 16442

[21] Appl. No.: 474,824

[22] Filed: Mar. 14, 1983

[51] Int. Cl.[3] ..... A45F 5/00

[52] U.S. Cl. ..... 224/252; 206/37; 206/234; 206/305; 206/349; 224/904

[58] Field of Search ..... 224/252, 255, 253, 904; 24/3 F, 3 J, 3 L, 11 CT, 11 HC; 206/37, 38, 234, 305, 349

[56] References Cited

U.S. PATENT DOCUMENTS

| | | | |
|---|---|---|---|
| 755,400 | 3/1904 | Sharp | 24/11 CT |
| 872,379 | 12/1907 | Schulz | 224/252 X |
| 1,286,597 | 12/1918 | Jennings | 224/252 X |
| 2,748,926 | 6/1956 | Leghy | 206/305 |
| 2,850,152 | 9/1958 | Marrufo | 206/38 X |
| 3,250,448 | 5/1966 | Clark | 224/253 X |
| 4,055,283 | 10/1977 | Habler | 224/252 X |

*Primary Examiner*—Allan N. Shoap
*Attorney, Agent, or Firm*—Charles L. Lovercheck; Wayne L. Lovercheck; Dale R. Lovercheck

[57] ABSTRACT

A micrometer holder is disclosed. A micrometer is a precise measuring instrument that should be protected against damage by impact and rough handling. The device disclosed herein has a pocket large enough to receive the measuring section of the micrometer and shoulders at the side of the protector extend out in front of the micrometer body. The outer sheet forming the micrometer holder is substantially longer than the inner sheet so that the holder is held in a shape to conform to the body of the wearer when the micrometer is worn on a belt so that the micrometer is held against inadvertent removal from the holder when the person leans over or the holder is jostled. The upper edge of the front of the holder is shaped to hold the rounded edge of the micrometer.

5 Claims, 5 Drawing Figures

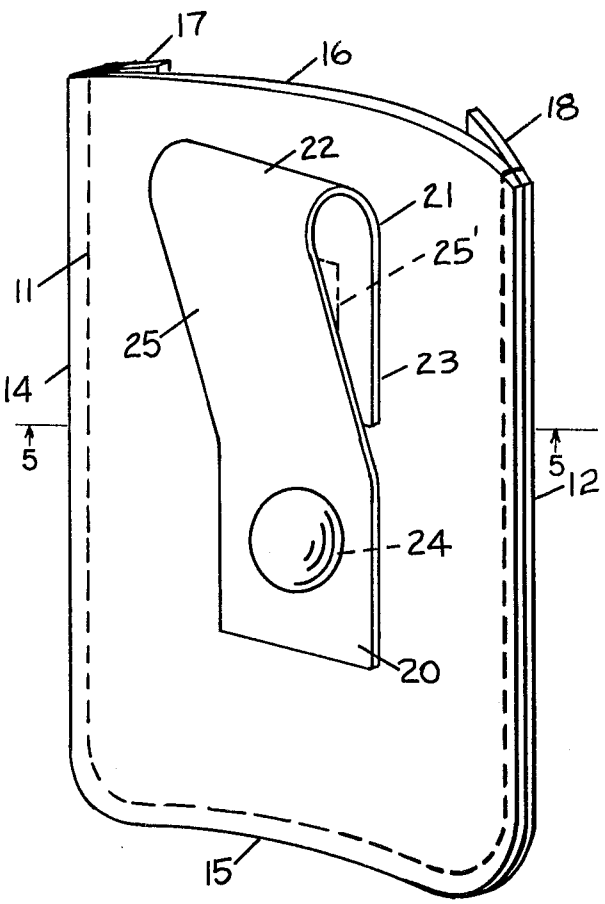
Fig. 2.
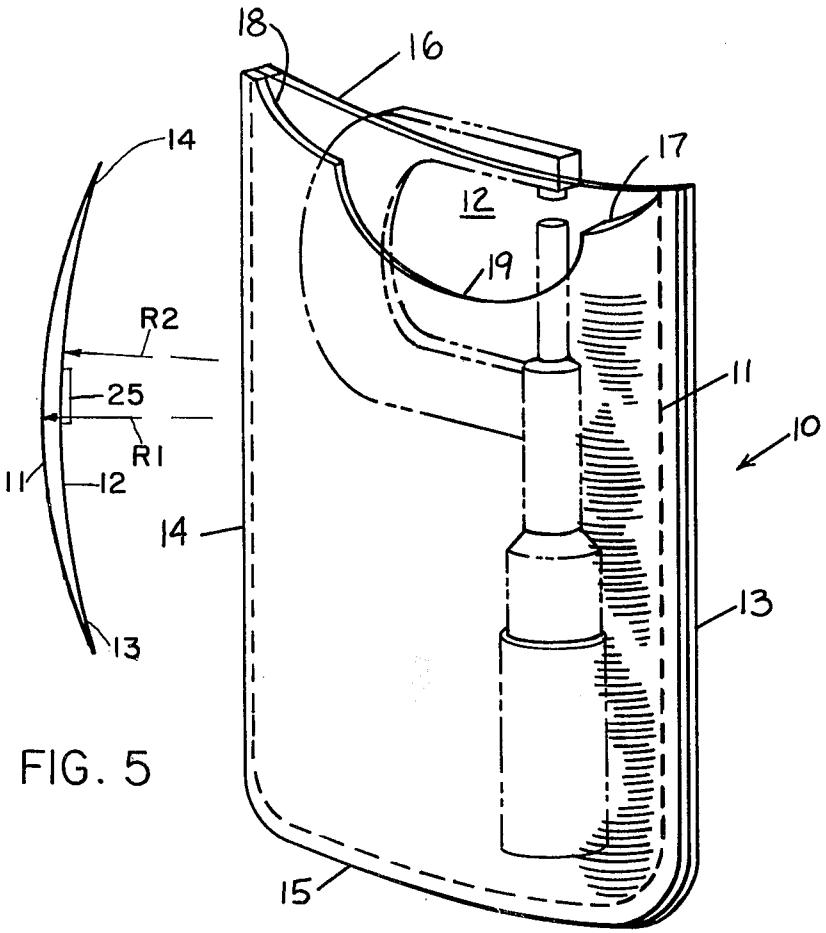
Fig. 1.
FIG. 5

MICROMETER HOLDER

GENERAL DESCRIPTION OF INVENTION

The micrometer holder disclosed herein may be made in the form of either a double holder or a single holder.

The double holder has two spaced belt receiving loops on the back to fit over a person's belt. The loops will preferably receive belts of width up to two inches. The double micrometer holder is designed to hold both outside diameter and wall micrometers used in tube mills, etc.; is double stitched in the middle for better flexibility to fit any size person's waist; is double stitched (clockwise and counter-clockwise) around outer edges and lock stitching is provided at stress points at center and at each edge.

The double micrometer holder can be used by right or left handed persons; it is easy and convenient to remove and to replace the micrometer; is easy to take the micrometer out by grasping it with fingertip; and the holder protects the micrometers from being damaged or lost by laying them down or carrying them in a pocket.

The double micrometer holder has closed bottoms so that in case its end comes off it will be in the holder; can be used to keep micrometers in when not in use and when they are put in a locker or tool crib.

The double micrometer holder belt loops on the back are designed so they can be worn on shop apron ties; it may be made of leather for longer wear; has two belt loops on the back for balance and comfort and can be locked in place by putting the belt end through the loop of holder then through loop on the wearer's pants then through the other loop of micrometer holder.

The single holder is designed for machinists and mechanics who ony need to use one micrometer. It is shaped and balanced for comfort and has a closed end so that in case an end of the micrometer comes off it will still be in the holder.

The single micrometer holder has one loop in back that fits over the person's own belt; can be worn on shop apron ties; has lock stitches on stress points (on each side); is double stitched (clockwise and counter-clockwise) for durability; and is made of leather for longer wear.

OBJECTS OF THE INVENTION

It is an object of the invention to provide an improved micrometer holder.

Another object of the invention is to provide a micrometer holder that may be worn on the belt of the user and the holder is made up of an inner sheet and an outer sheet. The outer sheet is wider than the inner sheet so that it causes the inner sheet to curve along with the outer sheet thereby providing a restraining feature for preventing the micrometer from inadvertently falling out of the holder.

Another object of the invention is to provide a micrometer holder for two micrometers.

Another object of the invention is to provide a micrometer holder that is simple in construction, economical to manufacture, and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

FIG. 1 is a front view of the micrometer holder according to the invention.

FIG. 2 is a rear view of the micrometer holder shown in FIG. 1.

FIG. 5 is a cross sectional view taken on line 5—5 of FIG. 4.

DETAILED DESCRIPTION OF DRAWINGS

Figure 3:
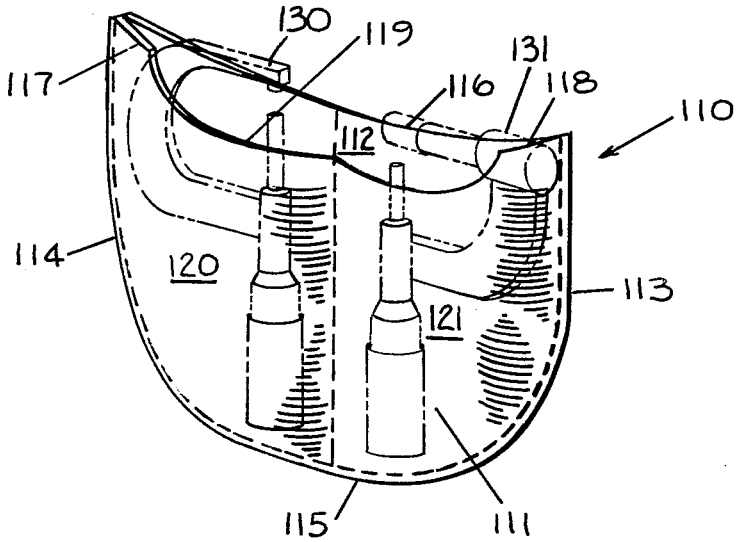
FIG. 3 is a front view of another embodiment of the invention.

A micrometer holder embodiment shown in FIGS. 1 and 2 is shown herein indicated generally at 10 and comprising a front sheet like member 11 and a rear sheet like member 12 which may be made of leather or other suitable durable material. The front member 11 is wider than the rear member 12. Therefore, both the front and back are caused to curve to conform to the body of a wearer and to exert a pressure on the micrometer to prevent it from inadvertently falling from the holder. The front curved sheet like member 11 and the rear curved sheet like member 12 of the micrometer holder each have a peripheral edge made up of a first edge 13 and a second edge 14 and a bottom edge 15 between the two side edges 13 and 14. The rear member 12 is curved about a lesser radius of curvature R1 than the radius of curvature R2 of the front member 11. The peripheral edges of the front member 11 and rear member 12 rest on each other and are sewed together along the peripherial edge so that they define a crescent shaped space between them. The front sheet and rear sheet exert opposing forces on a micrometer when a micrometer is placed between them and grip the micrometer to resist removal of it from the holder. The holder is the same width at the top and bottom so that the micrometer can face either way. The belt loop 25 on the rear member 12 is adapted to engage the body of the a person wearing it thereby deforming the rear member 12 about a greater radius of curvature R1 to cause the front and rear sheets to put pressure on both front and rear of a micrometer in the crescent shaped space to hold the micrometer snug. The belt loop 25 on the rear member can receive the belt of a person and the belt will hold the rear of the micrometer holder in place.

The rear member has an upper edge 16 extending generally perpendicular to the front edge 13 and second edge 14. The front member 11 has a first shoulder 17 and a second shoulder 18 extending toward the center of the holder and a central arcuate cut out 19 between the shoulders 17 and 18 is generally perpendicular to the side edges a distance from the stitching approximately equal to the diameter of the handle of an ordinary micrometer so that in use the shoulders will extend up in front of the micrometer body.

The belt loop 25 has first end 23 secured to the rear sheet 13 at 25'. The belt loop 25 is attached at a position adjacent its upper edge 22 spaced from the side edges 13 and 14 and it is bent back on itself forming a belt receiving part 21 adjacent the upper end and then sewed to the rear sheet at 25'. A snap 24 of a type familiar to those skilled in the art holds end 20 to the rear member 12.

Figure 4:
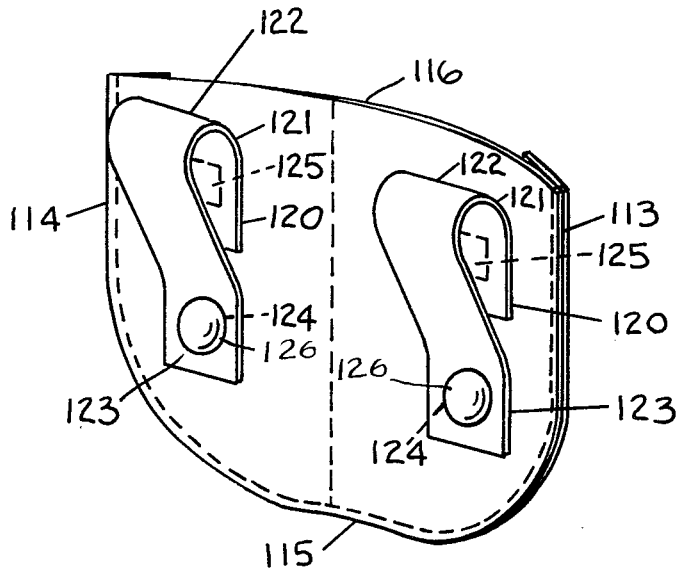
FIG. 4 is a view similar to FIG. 3 of the other embodiment of the invention.

Now, with reference to the embodiment of the invention shown in FIGS. 3 and 4, I show a double micrometer holder for holding two micrometers, an outside micrometer 130 and a wall micrometer 131. The micrometer holder has a first sheet 111 and a rear sheet 112. The front sheet 111 has a peripheral edge made up of a first side edge 113 and a second side edge 114 and a bottom edge 115. The peripheral edges 113, 114 and 115 rest on each other and are sewed along a line passing through said peripheral edge holding said peripheral edges together. A line of stitching passing through the central part of said holder dividing said holder into two parts, said rear sheet having an upper edge 116 and extending generally perpendicular to said first side edge 113 and a second side edge 114, said first member having a first shoulder 117 and second shoulder 118. The shoulders extending toward the center of the holder generally perpendicular to the side edges a distance from said side edges approximately equal to the diameter of a handle of an ordinary micrometer, and an arcuate cutout 119 is formed in the center of the front side and the belt holder having a loop having a first end attached to the rear wall. The rear wall is narrower than the front wall so that the front wall urges the rear wall into an arcuate shape while the front wall 111 forms two curved surfaces and two loops are sewed to the rear wall. The loops are indicated generally at 120. They are sewed to the rear wall at 124 and 125 extend upwardly therefrom then backward on themselves downwardly. Stitches at 124 may be sewed to the rear wall at the end 123 by means of sewing 124. Stitches at 124 and 125 may be in the form of a rectangle. The stitches 125 are about one-fourth of the way down from the top of the back. As an alternative fastening means, snap fasteners 126 may be used to enable the user to remove the holder from his belt without unbuckling his belt.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A micrometer holder comprising a front curved sheet like member, a rear curved sheet like member, said front curved sheet like member having a peripheral edge made up of a first side edge, a second side edge, and a bottom edge, said rear curved sheet like member having a peripheral edge made up of a first side edge, a second side edge, and a bottom edge, said peripheral edges resting on one another, said peripheral edges being sewed together holding said peripheral edges together, said rear sheet member being curved about a first lesser radius of curvature than the second radius of curvature about which said front curved sheet like member is curved about, a belt loop attached to said rear member and located within its radius of curvature, said radiuses of curvature having centers of curvature on the same side of said front and rear members whereby said curved sheet like members are held in nesting arched relation with a crescent shaped space therebetween for receiving a micrometer, said front curved sheet member having a first shoulder and a second shoulder adjacent said peripheral edges extending toward the center of said holder generally perpendicular to said side edges a distance from said stitching approximately equal to the diameter of a handle of an ordinary micrometer, an arcuate cutout in the upper end of said front sheet member defining a shoulder at each side thereof adapted to overlie the micrometer, said belt loop having a first end attached to said rear sheet member in a position approximately one-fourth of the way from the upper edge to the lower edge of said rear sheet member, said belt loop having a belt receiving part adjacent said upper edge, said belt loop being formed by a strap extending upwardly from said first end, then downward overlying said first end and said lower end forming said belt receiving portion.

2. The micrometer holder recited in claim 1 wherein said upper end of said strap being attached to said rear wall by means of stitching disposed in a generally rectangle pattern whereby said rear wall is held in an arcuate position with said front wall curving rearwardly and outwardly and said rear wall being curving rearwardly and outwardly.

3. The micrometer holder recited in claim 2 wherein said lower end of said strap is held in position by a snap member on said body and a complimentary snap member on said strap.

4. The micrometer holder recited in claim 1 wherein a central row of stitching is provided between said peripherial edges dividing said holder into two micrometer holding compartments, said first mentioned belt loop is attached to said rear sheet member on one side of said central row of stitching, and a second belt loop is attached to said rear sheet member at the other side of said central row of stitching whereby a second micrometer can be supported in said compartment.

5. The micrometer holder recited in claim 4 wherein said belt loops are each attached to said holder by stitching at a first end and by a snap fastener means at the other.

* * * * *